United States Patent [19]

Hashimoto

[11] 3,982,660

[45] Sept. 28, 1976

[54] TOOTH PICK HOLDER

[76] Inventor: Kimio Hashimoto, 2-3-22, Takeoka, Kiyose, Tokyo, Japan

[22] Filed: Nov. 6, 1975

[21] Appl. No.: 629,655

[30] Foreign Application Priority Data

Nov. 18, 1974 Japan ..... 49-138640

[52] U.S. Cl. ..... 221/190

[51] Int. Cl.[2] ..... B65D 83/02

[58] Field of Search ..... 221/254, 190

[56] References Cited

UNITED STATES PATENTS 2,233,120 2/1941 Andonov ..... 221/190

*Primary Examiner*—Stanley H. Tollberg

[57] ABSTRACT

A toothpick holder comprising a toothpick container capable of containing many toothpicks, a cover member mounted on this container, a toothpick ejecting unit fixed upright to the center of a support base so that the container and cover member are vertically movable relative to the ejecting unit, and resilient means. In response to forced downward movement of the cover member and container, a toothpick supported at the lower end thereof in a supporting recess formed at the upper end of the ejecting unit protrudes to be dispensed from a dispensing opening of a frusto-conical upper end of the cover member. After the toothpick is dispensed, the cover member and container are restored to the original non-operative position by the resilient means.

6 Claims, 6 Drawing Figures

TOOTH PICK HOLDER

BACKGROUND OF THE INVENTION

This invention relates to a toothpick holder which holds a multiplicity of toothpicks therein so as to be capable of dispensing one toothpick after another by simple external manipulation and is applicable to a variety of kinds of toothpicks of different lengths presently commercially available.

A variety of toothpick holders of such type have already been proposed. However, all of the already proposed ones have been defective in that they are quite complex in mechanism and tend to fail to properly function within a relatively short period of time of use. In an effort to obviate such defects, a toothpick holder has been proposed in which a container containing a multiplicity of toothpicks therein is arranged to be movable relative to a support base so that the toothpicks can be dispensed one by one each time the container is urged downward relative to the support base. Although this toothpick holder can operate reliably when the number of toothpicks charged in the container is nearly equal to the capacity and the toothpicks are contained in parallel with one another or lined up in the same direction within the container, the toothpicks tend to incline in random directions within the container when the number of the toothpicks in the container is decreased to less than about one half the number of the initially charged ones after repeated dispensing of the toothpicks. In such a case, the toothpicks remaining in the container are unable to move smoothly toward a toothpick receiver disposed at the bottom of the container as an integral part of the support base, and the toothpicks inclined in the random directions are frequently fractured by the downward external force produced by the downward movement of the container, resulting in impossibility of proper dispensing of the toothpicks. Thus, this prior art toothpick holder has also be defective in that it tends to be disabled due to the breakage of the toothpicks held therein.

BRIEF SUMMARY OF THE INVENTION

It is therefore a primary object of the present invention to provide a novel and improved toothpick holder which is free from the prior art defects pointed out above.

The toothpick holder according to the present invention comprises a substantially cylindrical container containing a multiplicity of toothpicks therein, a cover member having a frusto-conical guide wall formed with a toothpick dispensing opening at the center of the head portion thereof, a toothpick ejecting unit consisting of a rod having a recess at the upper end thereof for receiving and supporting one end of a toothpick to be dispensed and a plurality of spaced guide vanes fixed to the outer peripheral surface of the rod and freely slidable in guideways formed in the bottom of the container, and resilient means for restoring the container and cover member to the original position after a toothpick is dispensed by urging the container and cover member downward to the toothpick dispensing position along the toothpick ejecting unit.

DETAILED DESCRIPTION OF THE PREFERRED EMBODIMENTS

Figure 1:
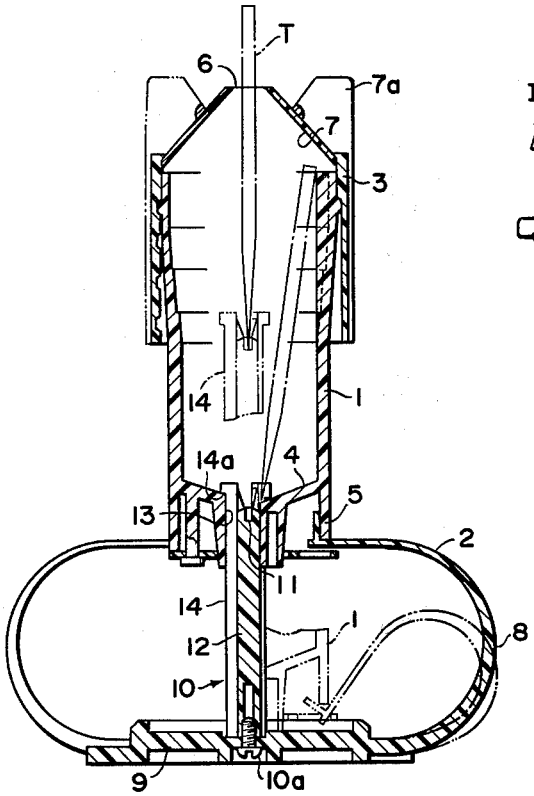
FIG. 1 is a vertical sectional view of a first embodiment of the toothpick holder according to the present invention, the section being taken along the line I-I in FIG. 2.

A first embodiment of the toothpick holder according to the present invention is basically composed of a toothpick container 1, a resilient support 2 and a cover member 3 as shown in FIG. 1.

Referring to FIG. 1, the container 1 is a substantially cylindrical member of synthetic resin. A funnel-shaped bottom 4 is formed in the lower end of the container 1, and the peripheral wall of the lower part of the container 1 extends downward to form an annular skirt 5. The cover member 3, which is also made of synthetic resin, is removably mounted on the upper part of the container 1, and the head portion of the cover member 3 is provided with a frusto-conical guide wall 7 for guiding a toothpick toward a dispensing opening 6. A plurality of finger-engaging plates or push plates **7*a* are fixed vertically and radially in equally circumferentially spaced apart relation to the outer surface of the guide wall 7 so that they can be conveniently used for depressing the container 1** and give a decorative external appearance to the toothpick holder.

Figure 2:
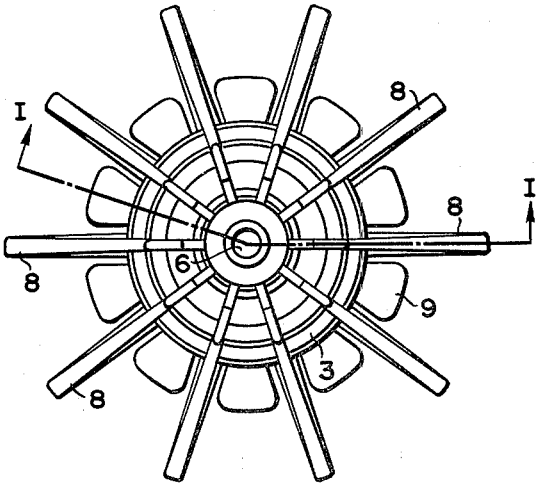
FIG. 2 is a plan view of the toothpick holder shown in FIG. 1.

The resilient support 2 comprises a plurality of strips 8 of resilient material such as synthetic resin or spring steel of flat, circular or any other suitable cross section. These strips 8 extend radially in equally circumferentially spaced apart relation from the peripheral edge of a circular base 9 and are bent in a semi-elliptical shape as shown in FIGS. 1 and 2. The cross-sectional size of the strips 8 is greatest at the stationary end and is gradually reduced toward the free end as clearly seen in FIG. 1. These strips 8 are engaged at the free end thereof by the inner wall of the skirt 5 extending downward from the container 1 during assembling so as to normally urge the container 1 upward toward the non-operative position.

Figure 3:
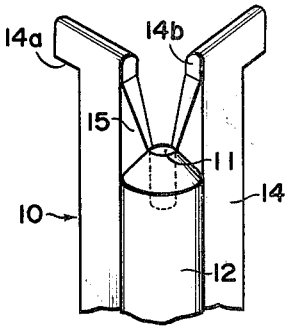
FIG. 3 is an enlarged perspective view of the upper portion of the toothpick ejecting unit in the toothpick holder shown in FIG. 1, with part cut away and one of the guide vanes removed for simplicity of illustration.
Figure 4:
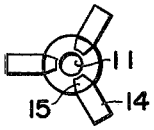
FIG. 4 is a plan view of the toothpick ejecting unit.

A toothpick ejecting unit 10 is securely fixed upright to the center of the circular base 9 by a set screw **10*a*. This toothpick ejecting unit 10 comprises an upstanding rod 12 which is formed at the upper end thereof with a recess 11 for receiving and supporting one end of a toothpick in this recess 11. A plurality of equally circumferentially spaced apart guide vanes 14 are fixed vertically and radially to the rod 12 and are received in associated guideways 13 formed along the wall of the vertical bore of the funnel-shaped bottom 4 of the container 1 for making sliding movement in the guideways 13. In the present embodiment, three such guide vanes 14 are provided as seen in FIG. 4. As clearly seen in FIG. 3, the upper end of each of these guide vanes 14 protrudes beyond the upper end of the rod 12 and is formed with a hook-shaped stopper 14*a* engaging normally with the funnel-shaped bottom 4 of the container 1, and the inner wall surface 14*b* of each of the guide vanes 14 is formed with a tapered rib 15** extending from a point adjacent to the top of the guide vane 14 to the peripheral edge of the toothpick supporting recess 11 of the rod 12.

Although a multiplicity of toothpicks T are previously charged into the container 1 in use, only one toothpick T is shown contained in the container 1 in FIG. 1 to avoid confusion of illustration. In operation, depression of the cover member 3 by the fingers of the user causes downward movement of the container 1 thereby yielding the strips 8 of resilient material, to a state as shown by the two-dot chain lines in FIG. 1. Due to the fact that the toothpick ejecting unit 10 is fixed to the base 9 and is thus maintained stationary, the upper end of the toothpick T, whose lower end is received in the supporting recess 11 of the rod 12, protrudes to the exterior from the dispensing opening 6 of the cover member 3 as shown by the two-dot chain lines in FIG. 1. In this manner, one toothpick T can be dispensed each time the cover member 3 is forced downward by the fingers of the users.

According to the present invention, the guide vanes 14 projecting beyond the upper end of the rod 12 in the toothpick ejecting unit 11 are each formed at the inner wall surface 14*b* thereof with the rib 15 extending to the peripheral edge of the supporting recess 11 of the rod 12. Therefore, even when the number of the toothpicks contained within the container 1 is decreased as a result of repeated dispensing, the ribs 15 act to regulate relative motion of the toothpicks remaining within the container 1 thereby preventing the remaining toothpicks from inclining in random directions and from entangling with one another. Thus, one toothpick after another can be smoothly and reliably received and supported at the lower end thereof in the supporting recess 11 of the rod 12, and all the toothpicks can be smoothly and reliably dispensed one after another until the last one is dispensed. Further, due to the fact that the cross-sectional area of the strips 8 constituting the resilient support 2 is gradually decreased toward the upper free end, the resistance against fatigue of the resilient support 2 can be increased. The strips 8 of such a shape can be easily formed.

Figure 5:
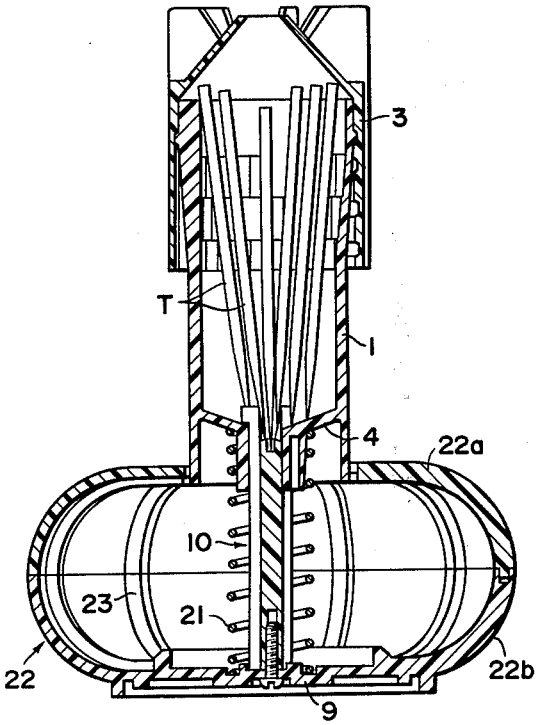
FIGS. 5 and 6 are vertical sectional views similar to FIG. 1, but showing a second embodiment of the toothpick holder according to the present invention.

FIGS. 5 and 7 show a non-operating state and an operating state respectively of a modification of the toothpick holder according to the present invention.

In this modification, a conventional coil spring 21 is employed in lieu of the resilient strips 8 employed in the first embodiment for restoring the container 1 and cover member 3 to the original non-operative position from the toothpick dispensing position. This coil spring 21 is disposed around the toothpick ejecting unit 10 between the funnel-shaped bottom 4 of the container 1 and the circular base 9 for normally urging the container 1 upward or toward the non-operative position. The reference numeral 22 designates a hollow member of flat oval cross-sectional shape formed by bending a plate of suitable transparent of opaque material such as plastic material. This hollow member 22 consists of an upper half portion 22*a* and a lower half portion 22*b* snap-fitted to the upper half portion 22*a* and serves to improve the stability of the toothpick holder. A plurality of decorative and reinforcing ribs 23 may be formed on this hollow member 22. The low half portion 22*b* of the hollow member 22 is fabricated as an integral part of the base 9.

Figure 6:
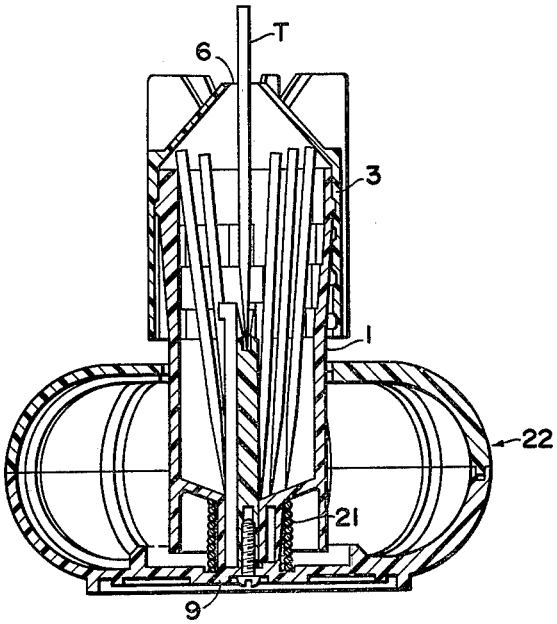

In operation, depression of the cover member 3 by the fingers of the user causes downward movement of the toothpick container 1 thereby compressing the spring 21 to establish a state as shown in FIG. 6. The upper end of one of the toothpicks T, whose lower end is received and supported in the supporting recess 11 of the rod 12 in the toothpick ejecting unit 10, protrudes to the exterior from the toothpick dispensing opening 6 of the cover member 3 so that such toothpick can be easily dispensed. Upon release of the force imparted to the cover member 3 after dispensing of the toothpick, the container 1 and cover member 3 are restored to the original position by the force of the spring 21 so that the next toothpick is ready to be dispensed.

What is claimed is:

1. A toothpick holder comprising:

a substantially cylindrical container capable of containing a multiplicity of toothpicks therein, said container having a funnel-shaped bottom formed as an integral element of the lower part thereof and also having an annular skirt extending downward from the lower peripheral wall thereof;

a cover member removably mounted on the upper part of said container, said cover member having a frusto-conical guide wall terminating in a toothpick dispensing opening in the upper part thereof for guiding one toothpick after another toward said dispensing opening during dispensing;

a toothpick ejecting unit fixed upright to the center of a support base, said toothpick ejecting unit including a rod having at the upper end thereof a recess for receiving and supporting one end of the toothpick to be dispensed, and a plurality of guide vanes fixed vertically to the outer peripheral surface of said rod in equally angular relationship and freely slidably received in associated guideways formed in said bottom of said container, each said guide vane protruding beyond the upper end of said rod and being formed on the inner wall surface thereof with a tapered rib which extends from a point adjacent to the top of said guide vane to the peripheral edge of said supporting recess formed at the upper end of said rod; and resilient means for restoring said container and said cover member to the original non-operative position after dispensing of the toothpick by forcing said container and said cover member downward along said ejecting unit to the toothpick dispensing position.

2. A toothpick holder as claimed in claim 1, wherein a plurality of vertically arranged finger-engaging plates are fixed radially in equally circumferentially spaced apart relation to the outer peripheral surface of said frusto-conical guide wall of said cover member.

3. A toothpick holder as claimed in claim 1, wherein a stopper is formed at the upper end of each said guide vane in said toothpick ejecting unit to engage with said bottom of said container.

4. A toothpick holder as claimed in claim 1, wherein said resilient means comprises a plurality of strips of resilient material bent into a semi-elliptical shape, and said strips extend radially in equally circumferentially spaced relation from the peripheral edge of said support base and are engaged at the free end thereof by said annular skirt extending downward from said container.

5. A toothpick container as claimed in claim 4, wherein each said strip has a cross-sectional area which is gradually decreased toward said free end thereof.

6. A toothpick holder as claimed in claim 1, wherein said resilient means comprises a coil spring disposed around said toothpick ejecting unit between said bottom of said container and said support base, and a hollow member having a flat oval cross-sectional shape is formed integrally with said support base.

* * * * *